US006926547B2

(12) United States Patent
Schoepf et al.

(10) Patent No.: US 6,926,547 B2
(45) Date of Patent: Aug. 9, 2005

(54) ELECTRICAL CONNECTOR

(75) Inventors: Thomas J. Schoepf, Rochester Hills, MI (US); Rafil Basheer, Rochester Hills, MI (US); Ismat Abu-Isa, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 224 days.

(21) Appl. No.: 10/013,147

(22) Filed: Dec. 10, 2001

(65) Prior Publication Data

US 2003/0008542 A1 Jan. 9, 2003

Related U.S. Application Data

(60) Provisional application No. 60/303,652, filed on Jul. 6, 2001.

(51) Int. Cl.[7] ..... H01R 13/53
(52) U.S. Cl. ..... 439/185; 439/921
(58) Field of Search ..... 439/181–186, 439/921; 174/142, 181, 184; 218/43–58

(56) References Cited

U.S. PATENT DOCUMENTS 3,860,322 A * 1/1975 Sankey et al. ..... 439/184
3,958,855 A * 5/1976 Oakes ..... 439/185
4,186,985 A * 2/1980 Stepniak et al. ..... 439/185
4,192,572 A * 3/1980 Stanger et al. ..... 218/54
4,464,004 A * 8/1984 Hegyi et al. ..... 439/182
4,843,199 A * 6/1989 Niemeyer ..... 218/43
4,863,392 A * 9/1989 Borgstrom et al. ..... 439/185
5,213,517 A * 5/1993 Kerek et al. ..... 439/187
5,401,173 A * 3/1995 Grandchamp et al. ..... 439/33
5,462,453 A 10/1995 Muller
5,475,193 A 12/1995 Perdoncin
5,530,047 A 6/1996 Watanabe et al.
5,717,183 A 2/1998 Lehmann et al.

(Continued)

FOREIGN PATENT DOCUMENTS

JP 1-157013 * 6/1989

*Primary Examiner*—Lincoln Donovan
(74) *Attorney, Agent, or Firm*—David P. Wood

(57) ABSTRACT

An arc quenching electrical connector has a male pin terminal which inserts longitudinally into a receptacle or terminal having a gassing wall engaged concentrically about the receptacle. During "hot unplugging" of the electrical connector, an arc is carried between a tip of the male pin and a contact surface of a leading end of the receptacle. The gassing wall extends over and is directly engaged to a portion of the contact surface. Because the gassing wall is also preferably an electrical insulator, the arc communicates electrically with the exposed contact surface and is biased directly against the gassing wall. The gassing wall, when heated by the adjacent arc, quenches or reduces the energy of the arc by releasing gas which eliminates arc erosion of the terminals.

21 Claims, 2 Drawing Sheets

U.S. PATENT DOCUMENTS 5,775,930 A 7/1998 Model et al.
5,925,863 A 7/1999 Zehnder et al.
5,990,440 A 11/1999 Yamaguchi et al.
6,017,971 A 1/2000 Mizoguchi et al.
6,071,153 A 6/2000 Fink et al.
6,142,813 A 11/2000 Cummings et al.
6,162,085 A 12/2000 Chugh et al.
6,168,445 B1 1/2001 Seutschniker et al.
6,171,146 B1 1/2001 Fink et al.
6,176,746 B1 1/2001 Morello et al.
6,179,658 B1 1/2001 Gunay et al.
6,203,364 B1 3/2001 Chupak et al.
6,210,186 B1 4/2001 Fink et al.
6,213,795 B1 4/2001 Drescher et al.
6,247,965 B1 6/2001 Cummings et al.
6,276,960 B1 8/2001 Schaefer et al.
6,305,957 B1 10/2001 Fink et al.
6,338,651 B1 1/2002 Svette, Jr. et al.
6,361,356 B1 3/2002 Heberlein et al.
6,379,162 B1 4/2002 Raypole et al.
6,383,033 B1 5/2002 Politsky et al.
6,406,307 B2 6/2002 Bungo et al.
6,416,119 B1 7/2002 Gericke et al.
6,422,881 B1 7/2002 Puhl et al.
6,485,318 B1 11/2002 Schoepf
6,485,337 B2 11/2002 Hsieh
6,494,751 B1 12/2002 Morello et al.
6,508,666 B1 1/2003 Francis
6,527,573 B2 3/2003 Stein, Sr. et al.
6,533,611 B2 3/2003 Morello et al.
6,537,099 B2 3/2003 Herlinger et al.
6,547,605 B2 4/2003 Daugherty et al.
6,565,372 B2 5/2003 Bakker et al.
6,607,393 B2 8/2003 Raypole et al.

* cited by examiner

ELECTRICAL CONNECTOR

This patent application claims priority of Provisional Patent Application No. 60/303,652 filed Jul. 6, 2001.

TECHNICAL FIELD

The present invention relates to an electrical connector, and more particularly to an arc suppressing electrical connector subjected to a high voltage.

BACKGROUND OF THE INVENTION

Power and signal distribution connectors mechanically and electrically connect at least two conductors at, ideally, the lowest possible power loss. Connectors are not designed to make and break a hot electrical circuit as are switches, relays and contactors. Nevertheless, during their service life connectors can be plugged and unplugged under load many times (i.e. "hot plugged"). Very often this disconnection under load occurs when physically switching off the power in advance would be considered time consuming and inconvenient. Also, connectors in automotive power networks are plugged and unplugged under load during diagnostic procedures, fuses are plugged at short circuit conditions, and so forth. Under some circumstances in the above situations, the connector suffers no significant damage with multiple engages/disengages. Other times, just one disconnect damages the terminals beyond repair. In other words, under specific conditions, a long arc may be generated at engage/disengage, which may cause extensive terminal erosion. This erosion may damage the physical shape of the terminal, preventing re-engagement or proper terminal contact forces after disengagement.

FIG. 1 depicts a known electrical connector 10 having a receptacle 12 and a male pin 14, wherein the male pin 14 has just been separated from the receptacle 12 and the tips or contacts 16, 18 of the terminals are presently within a terminal proximity zone or range 20. By "terminal proximity zone" is meant a spatial range over which an electrical arc 22 is most prone to arise when the terminals are subjected to an applied voltage (that is, when under load), in which the overall proximity zone length may vary depending, for example, upon circuit load and atmospheric conditions. Moreover, as the length or space between terminal contacts increases, within the established zone, the voltage and energy required to sustain the arc must also increase. If the energy reaches high enough proportions (an energy limited by the circuit voltage), arc erosion of the terminal contacts results. In other words, an electrical arc 22 will leap between the closest contacts 16, 18 of the terminals 12, 14 taking a most direct path there between. Because a most direct path is taken, the arc energy exposed to the contacts is maximal since it takes longer to sufficiently separate the contacts far enough to extinguish the arc. This results in a potential for terminal erosion.

Traditionally, the automotive industry utilizes a 14 volt direct current, VDC, power network. With such low voltages, no serious consequences are associated with plugging and unplugging under load due to very spatially short break arcs (the arc energy remains below that required to damage the contact material). However, the world's leading car manufactures and component suppliers are promoting 42 VDC power networks. Unfortunately, multiple matings and disconnects of a 42 VDC automotive network damages a standard connector terminal beyond repair because the break arcs are much longer and associated energy is higher. In other words, under specific conditions, a long arc may be generated at matings or disconnects which may cause high contact erosion. This erosion may damage the physical shape of the 42 VDC terminal preventing re-mating or hindering proper terminal contact forces after assembly.

Accordingly, it would be highly desirable if such arcs could be suppressed or quenched as soon as possible reducing the arc energy exposed to the contacts to eliminate contact erosion.

SUMMARY OF THE INVENTION

An arc quenching electrical connector has a terminal, preferably a male pin, which inserts longitudinally into a mating terminal or receptacle having a gassing wall engaged concentrically and directly about the receptacle. During "hot unplugging" of the electrical connector, an arc can occur and would be carried between a tip of the male pin and a contact surface of a leading end of the receptacle. The gassing wall extends over and is engaged directly to a portion of the contact surface. The contact surface preferably has an annular portion orientated closest to the tip of the male pin and a radial portion facing inward and engaged congruently to the inner perimeter of the annular portion. The gassing wall substantially extends over and is engaged directly to the annular portion of the contact surface.

Because the gassing wall is preferably an electrical insulator, a root of the arc does not substantially contact the annular portion of the contact surface which is closest to the tip of the male pin, but instead, directly contacts the radial portion of the contact surface. The arc root is therefore biased against or is adjacent to the gassing wall. This very close proximity of the arc to the gassing wall enhances the arc's ability to quickly heat the gassing wall through the metallic receptacle. When heated, the gassing wall preferably releases hydrogen gas which creates a pressure surge that bends the arc thereby causing the arc to reach its break arc length sooner which reduces the energy exposed to the contacts when hot unplugging/plugging the connector. The high thermal conductivity of hydrogen gas also serves to cool the arc root which dissipates the arc energy away from the contact surfaces.

An advantage of the present invention in the ability to quench an arc when "hot plugging or unplugging" an electrical connector which substantially reduces arc produced terminal erosion.

Another advantage of the present invention is the ability to manufacture automotive power networks having voltages in excess of 14 VDC.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENTS

Figure 1:
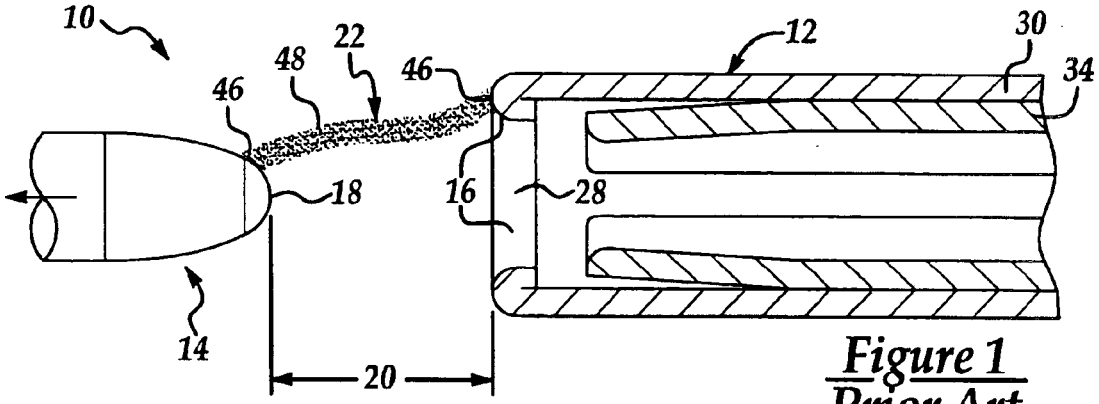
Figure 1 Prior Art
FIG. 1 is a partial cross section view of a prior art electrical connector showing an electrical arc.
Figure 2:
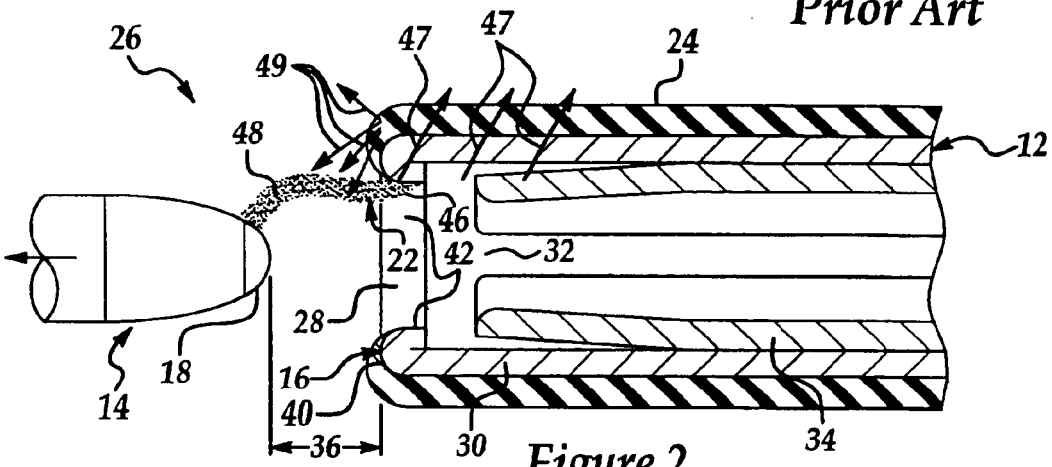
FIG. 2 is a partial cross section view of an electrical connector of the present invention.

As previously noted, FIG. 1 illustrates a known electrical connector 10 being disconnected under hot terminal conditions, thereby producing the arc 22 within the terminal proximity zone 20. FIG. 2 shows the same base connector 10 having an arc quenching, gassing wall 24, which releases gas when heated, thereby producing the electrical connector 26 of the present invention. The electrical connector 10 is known as a "Micro-Pack 100 W," manufactured by Delphi Packard Inc. However, the reliability of any other electrical connector which produces an arc between opposing contacts when disconnected within a hot circuit can be improved with the utilization of the gassing wall 24 having a similar orientation as that of FIG. 2.

During "hot un-plugging" of the electrical connector 26, the second terminal or male pin 14 is withdrawn longitudinally through a rearward hole 28 defined at the end of a metallic or stainless steel outer sleeve 30 of the receptacle 12 from a forward hole 32 defined by an inner spring contact sleeve 34 disposed concentrically within and engaged to the outer sleeve 30. The contact sleeve 34 is flexed resiliently and radially outward to provide a lateral inward force against the male pin 14 thereby achieving a reliable electrical connection.

The electrical connector 26 has a characteristic terminal proximity zone 36 which is substantially shorter than the terminal proximity zone 20 of the known connector 10 attributable to the gassing wall 24 which externally surrounds and is engaged directly and concentrically to the outer sleeve 30 of the receptacle 12. The smaller the proximity zone 36, the lower the arc energy transferred to the terminals 12, 14 and the smaller the opportunity for contact erosion. The trailing rear end contact surface 16 of the outer sleeve 30 has a substantially annular portion 40 which faces rearward and a radial portion 42 which is exposed or faces radially inward and opposes the male pin 14 when the electrical connecter 26 is mated. The proximity zone 36 is generally measured axially between the annular portion 40 of the receptacle 12 and the contact tip or surface 18 of the disengaged male pin 14.

The outer limit or maximum distance of the proximity zone 36 is dictated by the extinguishing or quenching point of the arc 22. In other words, as the contact surface 18 of the male pin 14 moves rearward from the annular portion 40 of the receptacle 12 within a "hot" circuit, the voltage of the resultant arc 22 continues to increase while the current decreases simultaneously. The arc 22 dissipates when the current reaches zero. At the point of arc dissipation, dictated by the circuit voltage and current, the distance between the contact surface 18 and the annular portion 40 generally establishes the outer limit of the proximity zone 36. The higher the circuit voltage, the longer the proximity zone 36 tends to be. Because energy is directly proportion to the product of voltage, current and time, it is preferable to reach current zero as soon as possible, thereby decreasing arc induced erosion and melting of the contacts by reducing the total energy exposed to the contact surfaces.

The gassing wall 24 accomplishes this reduction in energy, thereby favorably shortening the proximity zone from the zone 20 of the prior art in FIG. 1 to the zone 36 of the present invention by the release of hydrogen gas 49 when heated which first causes a pressure surge or front within the zone 36 which bends a column 48 of the breaking arc defined in length by the circuit voltage, and second, by cooling a root 46 of the arc thereby dissipating its energy. The column 48 is disposed between two roots 46 at either end of the arc. The roots 46 directly contact the contact surfaces. Although any gas will suffice to bend the arc 22, the high thermal conductivity of hydrogen gas makes it ideal for cooling the root 46.

Unlike the art of electrical switches, the gassing wall 24 is engaged directly to a substantial portion of the annular portion 40 of the contact surface 16 and is thereby disposed axially between the contact surface 18 of the male pin 14 and the contact surface 16 of the receptacle 12. Therefore, and because the gassing wall 24 also has electrical insulating characteristics, an arc root 46 of the arc 22 electrically contacts the radial portion 42 instead of the closer annular portion 40 of the contact surface 16. Yet, the energy transmitting root 46 is biased against the gassing wall 24 directly adjacent to the closer annular portion 40 because the arc 22 has a tendency to travel the shortest distance between two oppositely charged contact surfaces. Because of this close proximity, the root 46 of the arc 22 heats the high thermally conductive metallic outer sleeve 30 which in turn heats the adjacent gassing wall 24. The substantial heat flow direction is designated by arrows 47 of FIG. 2. As the gassing wall 24 heats, it releases the hydrogen gas 49 which in turn creates a pressure front or wave within the adjacent proximity zone 36 that bends the arc 22, and simultaneously cools the root 46 of the arc 22, thereby dissipating the energy of the arc 22. This is unlike the art of switches which utilize gas to cool the column of the arc, not the root.

Figure 3:
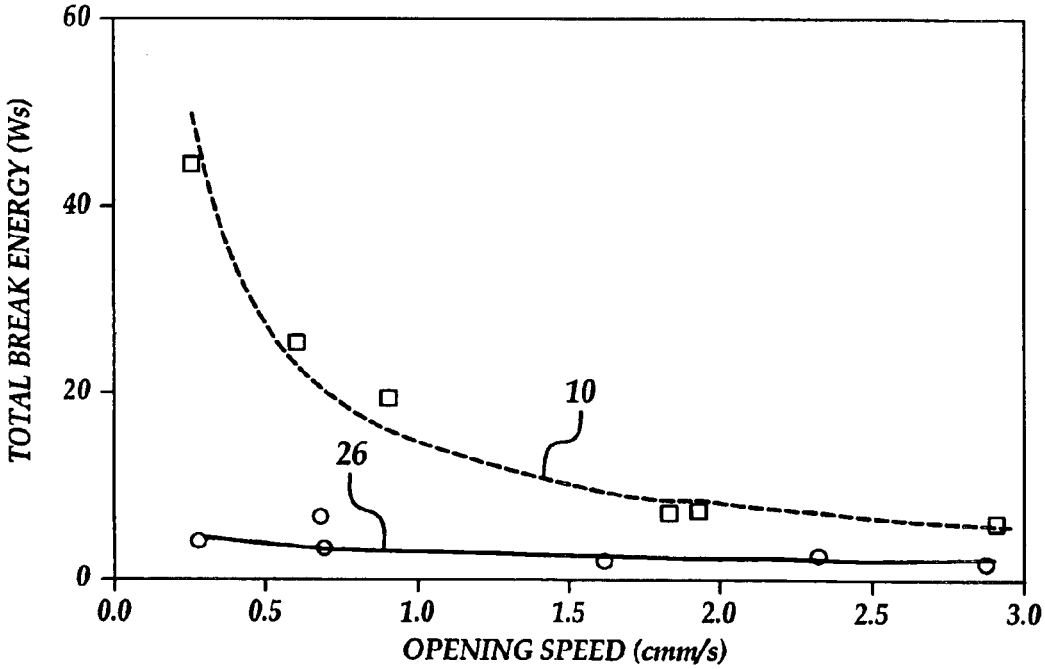
FIG. 3 is a comparison graph of total break energy verses opening speed.

Referring to FIG. 3, a graph of "Total Break Energy verse Opening Speed" depicts the difference in break energy between the known connector 10 and the connector 26 utilizing a gassing wall 24 of the present invention while holding the withdrawal or opening speed constant. It is apparent that a vast improvement in the reduction of terminal erosion and melting is gained by the electrical connector 26 over the connector 10, especially at slower opening speeds.

Figure 4:
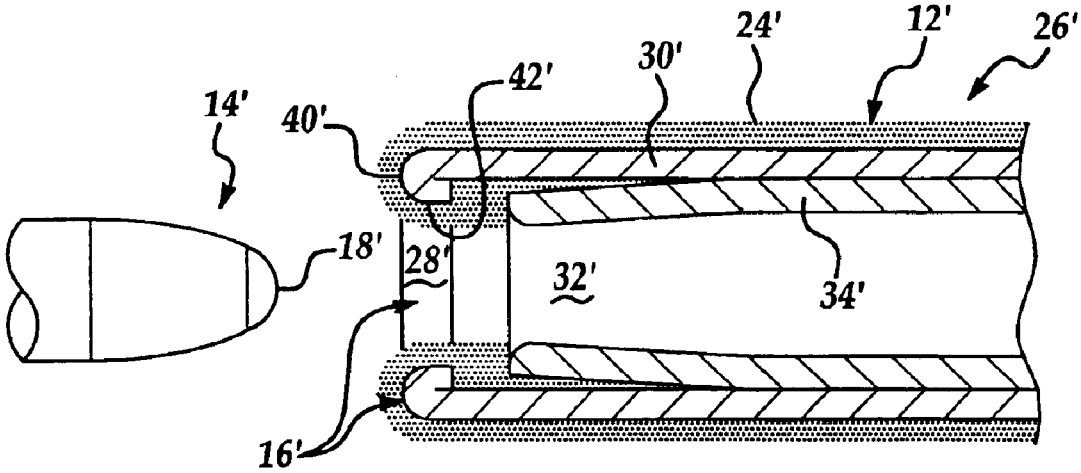
FIG. 4 is a partial cross section view of a second embodiment of an electrical connector of the present invention.

The gassing wall 24 can be made of a polymer material such as flame retardant polyolefin rubber, neoprene or polypropylene and may further take the form of heat shrink tubing or ceramic as suggested and illustrated by FIG. 2. Referring to FIG. 4, a second embodiment of the present invention is illustrated. In this embodiment, a gassing wall 24' of an electrical connector 26' takes the form of a gel or oil material which encases all exposed surfaces of the outer sleeve 30' including those surfaces facing radially inward from the outer sleeve 30'. Either form which contains hydrogen (e.g. carbon-hydrogen chain compositions) are capable of releasing hydrogen as a gas when heated.

Figure 5:
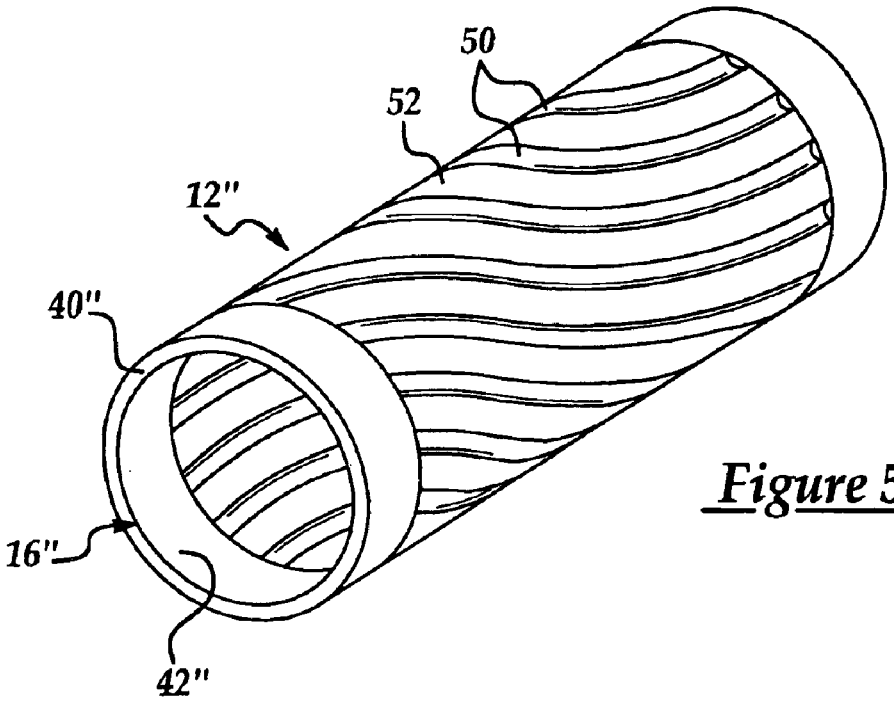
FIG. 5 is a perspective view of a third embodiment of an electrical connector of the present invention having a gas releasing insulator removed to show internal detail.

Referring to FIG. 5, a third embodiment of the electrical connector 26" has a spiral wound or spring based receptacle 12", having a series of spiral wound grooves or gaps 50 juxtaposed between a series of spiral wound spring members 52. The receptacle 12" is known as a Radsok® electrical connector manufactured by KonneKtech Division of K & K. A gassing wall 24", not shown in FIG. 5 to show detail of the receptacle 12", takes the form of a gel, encases the receptacle 12", and is embedded into the grooves 50 to prevent any arcing between the electrically conductive spring members 52. The gassing wall 24" is otherwise disposed similar to that of the first two embodiments.

Although the preferred embodiments of the present have been disclosed various changes and modifications may be made thereto by one skilled in the art without departing from the scope and spirit of the invention as set forth in the invented claims. Furthermore, it is understood that the terms used here are merely descriptive rather than limiting and various changes may be made without departing from the scope and spirit of the invention.

What is claimed is:

1. An electrical connector capable of suppressing an electrical arc, the electrical connector comprising:

a receptacle having a contact surface;

a male pin having an exposed contact tip engaged electrically to the receptacle which provides the electrical continuity of the electrical connector of the electrical connector when mated;

a gassing wall engaged around the receptacle and having a portion disposed directly adjacent to the contact surface;

the electrical arc having a column, a first root and an opposite second root, wherein the column extends between the first root being in electrical contact with the exposed contact tip; and wherein a gas released by the gassing wall when heated by the arc cools the adjacent first root for protecting the contact surface from erosion.

2. The electrical connector set forth in claim 1 wherein the gassing wall is also an electrical insulator.

3. The electrical connector set forth in claim 2 wherein:

the receptacle has a rearward hole defined by the contact surface; and the male pin projects through the hole of the receptacle and engages the contact surface of the receptacle when the electrical connector is mated.

4. The electrical connector set forth in claim 3 comprising:

the contact surface having an annular portion and an axial portion, the annular portion extending radially between an inner and outer perimeter, the outer perimeter being directly adjacent to the gassing wall, the axial portion extending rearward from the inner perimeter and engaged to the pin when the electrical connector is mated;

the gassing wall having a leading surface surrounding the annular portion of the contact surface; and wherein the axial portion is protected from erosion by the release of the cooling gas.

5. The electrical connector set forth in claim 4 wherein the annular portion of the contact surface and the leading surface of the gassing wall each lie substantially within an imaginary plane that traverses the electrical connector.

6. The electrical connector set forth in claim 2 wherein the gassing wall is polymer.

7. The electrical connector set forth in claim 6 wherein the polymer releases hydrogen gas when heated.

8. The electrical connector set forth in claim 7 wherein the gassing wall is shrink tubing.

9. The electrical connector set forth in claim 2 wherein the gassing wall is heat shrink tubing.

10. The electrical connector set forth in claim 2 wherein the gassing wall is flame retardant intumescent material.

11. The electrical connector set forth in claim 2 wherein the gassing wall is ceramic.

12. The electrical connector set forth in claim 2 wherein the gassing wall is selected from the group consisting of polypropylene, rubber, neoprene, gel, flame retardant paint and oil.

13. The electrical connector set forth in claim 5 wherein the receptacle is a spring based terminal having spiraling gaps, and wherein the gassing wall is a gel, disposed in the gaps and encasing the spring based terminal.

14. the electrical connector set forth in claim 5 wherein the receptacle is a spring based terminal having spiraling gaps and wherein the gassing wall is flame retardant paint disposed in the gaps and encasing the spring based terminal.

15. An electrical connector capable of suppressing an electrical arc, the electrical connector comprising:

a terminal pin having an exposed contact tip;

a receptacle having a rearward hole and a contact surface having an annular portion facing rearward and a radial portion facing radially inward and projecting axially forward and congruently from an inner perimeter of the annular portion, the annular portion defining the rearward hole, the terminal pin being inserted through the hole when the electrical connector is mated;

a gassing wall engaged to the annular portion of the contact surface of the receptacle, the gassing wall disposed axially between the receptacle and the terminal pin when the electrical connector is un-mated, the gassing wall being an electrical insulator;

the electrical arc having a column, a first root and an opposite second root, the column extends between first root being in electrical contact with the radial portion of the contact surface of the receptacle and disposed directly adjacent to the gassing wall and the second root being in electrical contact with the terminal pin; and wherein a gas released by the gassing wall when heated by the arc cools the first root disposed adjacent to the contact surface.

16. The electrical connector set forth in claim 2 comprising a heat flow direction produced by the arc and flowing via conduction directly from the contact surface directly to the gassing wall disposed directly adjacent the contact surface.

17. The electrical connector set forth in claim 15 comprising a heat flow direction produced by the arc and flowing via conduction directly from the radial portion of the contact surface directly to the gassing wall disposed directly adjacent and axially rearward of the contact surface.

18. The electrical connector set forth in claim 1 wherein the receptacle comprises an outer sleeve and an inner sleeve, the outer sleeve having the contact surface and the inner sleeve being disposed within the outer sleeve and contacting an inner surface of the outer sleeve.

19. The electrical connector as defined in claim 18 wherein the inner sleeve has a rearward end spaced forwardly of the contact surface.

20. The electrical connector as defined in claim 18 wherein the inner sleeve is a spring contact sleeve.

21. The electrical connector as defined in claim 19 wherein the inner sleeve is a spring contact sleeve.

* * * * *